United States Patent [19]

Song

[11] Patent Number: 5,031,420

[45] Date of Patent: Jul. 16, 1991

[54] PENDANT CONNECTOR

[76] Inventor: Chang J. Song, 6740 Comstock Rd., Richmond, B.C., Canada, V7C 2X6

[21] Appl. No.: 517,987

[22] Filed: May 2, 1990

[51] Int. Cl.[5] ..... A44C 11/00

[52] U.S. Cl. ..... 63/21; 63/2; 63/23

[58] Field of Search ..... 63/21, 23, 24, 2, 1.1, 63/18

[56] References Cited

U.S. PATENT DOCUMENTS

| | | | |
|---|---|---|---|
| 393,239 | 11/1888 | Johnstone | 63/1.1 |
| 773,376 | 10/1904 | Crandall . | |
| 786,217 | 3/1905 | Howard | 63/24 |
| 867,051 | 9/1907 | Korf . | |
| 1,028,217 | 6/1912 | Jacques | 63/21 |
| 1,038,740 | 9/1912 | Fuller . | |
| 3,116,616 | 1/1964 | Bangs . | |
| 3,533,247 | 10/1970 | Douglas . | |
| 3,877,250 | 4/1975 | Musillo | 63/23 |
| 4,265,098 | 5/1981 | Wayne . | |
| 4,430,869 | 2/1984 | Zinni . | |

FOREIGN PATENT DOCUMENTS

| | | | |
|---|---|---|---|
| 491630 | 2/1919 | France | 63/2 |
| 17083 | of 1888 | United Kingdom | 63/24 |

*Primary Examiner*—Laurie K. Cranmer

*Attorney, Agent, or Firm*—Townsend and Townsend

[57] ABSTRACT

A device for removably attaching a pendant to a decorative chain is disclosed. The device comprises two arcuate latching elements. The first latching element receives the chain and has an arm swivably attached to one end, which engages the other end when it is swiveled to a closed position, thereby creating a closed, locked loop around the chain. The second latching element receives a connecting loop on the pendant to be attached to the chain. The second element has a locking bar swivably attached adjacent to an eyelet on one end. The eyelet is adapted for receiving the first latching element. The locking bar has a longitudinal opening through which the eyelet protrudes when the locking bar is swiveled to a closed position, the locking bar thereby creating a closed, locked loop around the connectinhg loop on the pendant. When the two elements are interlocked in this manner, they are oriented at right angles to each other. The device of the present invention allows the attachment of substantially flat pendants to chains so that the front face of the pendant can be seen.

4 Claims, 1 Drawing Sheet

PENDANT CONNECTOR

BACKGROUND OF THE INVENTION

The present invention relates generally to ornamental jewelry, more particularly to a novel device for attaching a pendant to a decorative chain.

The prior art provides no reliable method for attaching a substantially flat pendant to a necklace or long chain when the pendant possesses a connecting loop oriented at right angles to its front face. When a single connecting loop is used, such a pendant will not hang correctly because the front face will be at right angles to the longitudinal axis of the necklace.

SUMMARY OF THE INVENTION

The present invention provides an aesthetically pleasing solution to this problem by using two interlocking latching elements. One element is hung from the other by means of a small eyelet that allows the two elements to be oriented at right angles to each other and also eliminates excess play between the two elements. The element bearing the eyelet possesses a locking bar having a longitudinal slot that permits the eyelet to engage the other latching element even after the bar is swiveled to its locked position.

According to the present invention, a device is provided for removably attaching a pendant to a decorative chain, usually a necklace. The device comprises a pair of interlocking arcuate latching elements. The first element receives the chain and has an arm swivably attached to one end which engages the other end of the element when it is swiveled to a closed position. When the arm is closed, a locked loop around the chain is formed. The second latching element receives a connecting loop on the pendant to be attached to the chain. The second element has a locking bar swivably attached at a point adjacent to an eyelet on one end. The eyelet is adapted for receiving the first latching element before its arm is swiveled to a closed position. When the two elements are interlocked in this manner, they are oriented at right angles to each other. The use of the eyelet to interlock the two elements prevents excess play that would occur if two interlocking loops were used. The locking bar has a longitudinal opening through which the eyelet protrudes when the locking bar is swiveled to a closed position. When the locking bar engages the opposite end, it creates a closed, locked loop around the connecting loop on the pendant.

Using the present invention, a pendant which is substantially flat and has a connecting loop oriented transverse to the front face can be hung from a necklace. Unlike the prior art, the claimed device allows the pendant to be attached so that the front face can be seen because it hangs parallel with the longitudinal axis of the chain.

DETAILED DESCRIPTION OF THE DRAWINGS

Figure 1:
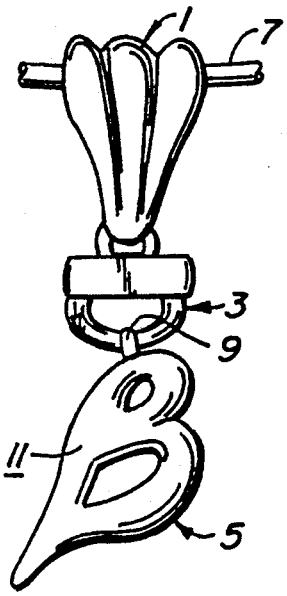
FIG. 1 is a front elevational view of the present invention attached to a decorative chain and pendant.

Referring now to FIG. 1 the device of the present invention can be seen to include a first arcuate latching element 1 and a second arcuate latching element 3. The device allows a pendant 5 to be attached to a decorative chain 7, typically a necklace. The first and second latching elements 1 and 3 can be formed by any standard method known in the art, including, but not limited to, lost wax molding, casting or the like. The elements can be formed from any standard material known in the art including, but not limited to, gold, silver, or brass. In the embodiment illustrated, the pendant 5 is substantially flat with a connecting loop 9 oriented transverse to the front face 11 of the pendant 5. The device of the present invention allows for the attachment of the pendant 5 to a chain 7 such that pendant's front face 11 can be located parallel with a longitudinal line generally defined by that portion of the chain 7 to which the latching element attaches. Thereby, the pendant 11 is better able to be seen. In the prior art, such a pendant could not be attached to a necklace because the orientation of the pendant would be incorrect.

Figure 2:
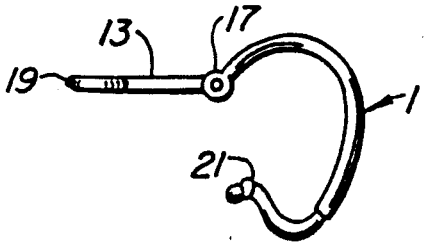
FIG. 2 is a side elevational view of the first latching element of the present invention.

Referring now to FIG. 2 the first latching element 1 is seen to include an arm 13 attached to a first end 15 of the first latching element 1 by a hinge 17. The arm 13 can be swiveled to a closed position so that the end 19 engages the second end 21 of the first latching element 1.

Figure 3:
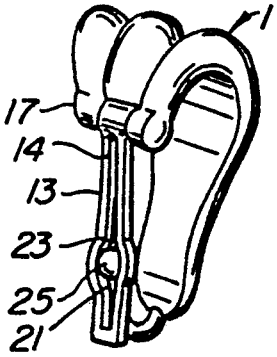
FIG. 3 is a front elevational view of the second latching element of the present invention.

FIG. 3 illustrates one embodiment of the present invention in which the arm 13 is formed to have an aperture 23 at the end 19 of the arm 13 that engages the second end 21 of the first latching element 1. The second end 21 is formed to have a bulb 25 that prevents the arm 13 from inadvertently slipping off the second end 21. Preferably, the arm 13 is constructed to receive and removably capture the bulb 25, placing the latching element in a latched condition. For this purpose, the arm 13 is constructed to have an elongate slit 14 of sufficient resilience to removably receive and hold the bulb 25.

Figure 4:
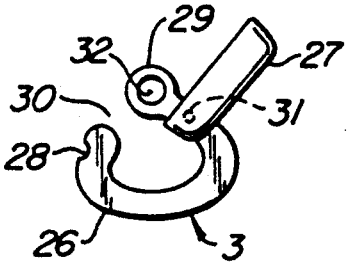
FIG. 4 is a perspective view of the first latching element of the present invention.
Figure 5:
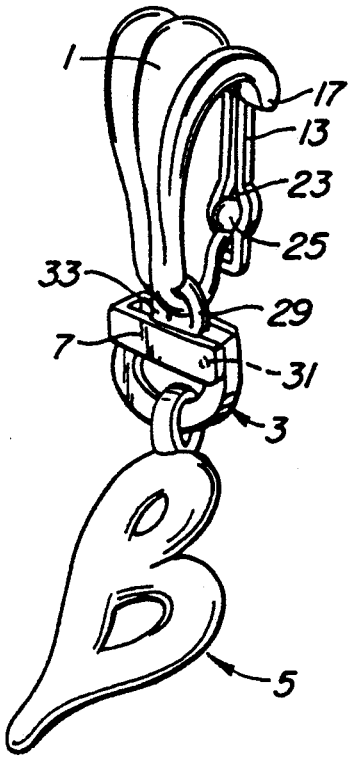
FIG. 5 is a perspective view of the two latching elements of the present invention.

As FIGS. 4 and 5 show, the second latching element 3 is of two-piece construction: (1) an arcuate member 26 having a pair of terminating ends 28 and 29 that define an opening 30, and (2) swivably attached to the arcuate member 28, at 31, adjacent to the end 29, a locking bar 27. Formed in the end 29 is an eyelet 32. The locking bar 27 is provided, in the top thereof, with a longitudinal opening 33 (FIG. 5) through which the eyelet 32 is adapted to protrude when the locking arm is swivelled to a position that closes the latching element 3, as illustrated in FIG. 5.

FIG. 5 illustrates the complete device and the interaction of the first and second latching elements 1 and 3. After a pendant 5 is attached to the second latching element 3 and the locking bar 27 is locked into place, the eyelet 29 engages the second end 21 of the first latching element 1. The arm 13 of the first latching element 1 is then swiveled into place thus locking the first latching element 1 to the second latching element 3. At the same time, the first latching element forms a closed locked loop around the chain 7, so that the pendant 5 is attached to the chain 7.

Although the best mode contemplated for carrying out the present invention has been herein shown and described, it will be apparent that modification and variation may be made without departing from what is regarded to be the subject of the invention.

What is claimed is:

1. A device for removably attaching a pendant to a decorative chain having a longitudinal axis, the device comprising:

a first arcuate latching element for receiving the chain, the first element comprising a first end, a second end, and an arm swivably attached to the first end, the arm engaging the second end when the arm is swiveled to a closed position, thereby creating a closed, locked loop around the chain;

a second arcuate latching element for receiving a connecting loop on the pendant, the second element comprising an end having an eyelet, an opposite end, and a locking bar swivably attached adjacent to the eyelet end, the eyelet being adapted for receiving the second end of the first latching element such that each latching element is oriented at a right angle to the other, the locking bar having a longitudinal opening through which the eyelet protrudes when the locking bar is swiveled to a closed position, the locking bar thereby engaging the opposite end and creating a closed, locked loop around the connecting loop on the pendant.

2. A device according to claim 1 wherein the arm is shaped to have an aperture and the second end is formed to terminate in a bulb, and wherein the aperture receives the bulb when the arm is swivelled to a closed position.

3. A device according to claim 1 wherein the chain is a necklace.

4. A device according to claim 1 wherein the pendant is substantially flat, having a front face and a connecting loop oriented transverse to the front face.

* * * * *